United States Patent [19]

Virgini

[11] Patent Number: 4,934,071

[45] Date of Patent: Jun. 19, 1990

[54] PVC INSOLE WITH FLAT BOTTOM AND WITH THE TOP SURFACE MADE UP OF HOLLOW HUMPS

[75] Inventor: Vincenzo Virgini, Loreto (AN), Italy

[73] Assignee: AL.VI. - S.r.1., Loreto (AN), Italy

[21] Appl. No.: 285,062

[22] Filed: Dec. 16, 1988

[30] Foreign Application Priority Data

Apr. 1, 1988 [IT] Italy ..... 524B/88

[51] Int. Cl.[5] ..... A43B 13/20

[52] U.S. Cl. ..... 36/29; 36/43; 36/44

[58] Field of Search ..... 36/28, 29, 30 R, 32 R, 36/43, 44, 11.5, 88; 128/594

[56] References Cited

U.S. PATENT DOCUMENTS

| | | | |
|---|---|---|---|
| 2,090,881 | 8/1937 | Wilson | 36/29 |
| 3,589,037 | 6/1971 | Gallagher | 36/44 |
| 4,217,705 | 8/1980 | Donzis | 36/29 |
| 4,345,387 | 8/1982 | Daswick | 36/29 |
| 4,779,359 | 10/1988 | Famolare | 36/29 |

FOREIGN PATENT DOCUMENTS

| | | | |
|---|---|---|---|
| 604587 | 9/1978 | Switzerland | 36/44 |
| 2102669 | 2/1983 | United Kingdom | 36/43 |

*Primary Examiner*—Werner H. Schroeder
*Assistant Examiner*—Diana L. Biefeld
*Attorney, Agent, or Firm*—Leonard Bloom

[57] ABSTRACT

The instant invention concerns an insole with a flat bottom and with the top surface made up of hollow semispherical or cylindrical humps. Once this insole has been affixed to the sole, whether it be made of PVC foam or polyurethane or wood or any other material, a single piece is formed with a series of completely air-tight air tubes.

5 Claims, 4 Drawing Sheets

PVC INSOLE WITH FLAT BOTTOM AND WITH THE TOP SURFACE MADE UP OF HOLLOW HUMPS

DESCRIPTION

Figure 1:
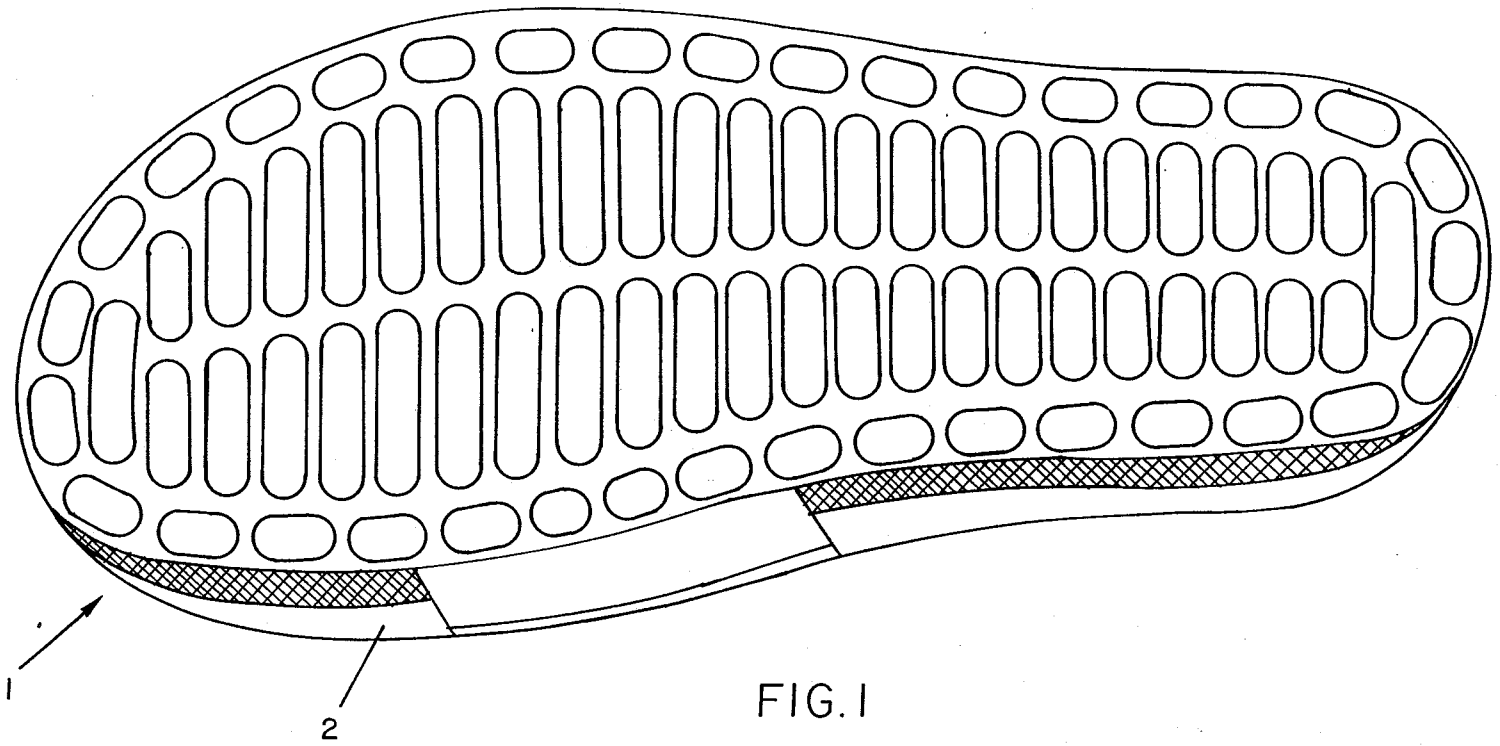

The instant invention concerns an insole with a flat bottom and with the top surface made up of hollow semispherical or cylindrical humps. Once this insole has been affixed to the sole, whether it be made of PVC foam or polyurethane or wood or any other material, a single piece is formed with a series of completely air-tight air tubes. As is known to operators in the field, insoles have been produced for some time now, mostly moulded in plastic, which due to their shape carry out an efficacious and healthy massaging action on the ball of the foot when walking.

This type of insole, known on the market as "auto-massaging insole", is mostly applied to the soles of footwear with open uppers, such as, clogs or mules, where, in fact, the upper is composed merely of a transversal band which surrounds the top of the foot, near the toes which are usually uncovered.

Up to the present time, to obtain this massaging action, there was a closely packed series of humps, with a rounded top surface, projecting from an insole, which bent laterally and elastically under pressure from the foot, returning to the erect position each time this pressure was reduced.

Taking into considersation the fact that when walking, the ball of the foot is in constant alternate motion from the tips of the toes to the heel, said flexible humps are subject to deflection under pressure, which varies both in intensity and direction, therefore said humps, due to their undulation, are able to carry out a mini-massage on the ball of the foot, which is known to be beneficial in stimulating constant and uniform blood circulation in the limb.

The major problem encountered in this type of auto-massaging insole, lies in the fact that although the abovementioned humps are flexible enough to bend elastically under pressure from the foot, they are not able to provide the ball of the foot with a surface on which to rest, which is soft and relaxing enough, above all during the time when the foot is resting completely flat.

In fact, even if said humps have a rounded top surface, they are nonetheless sufficiently rigid to be rather too harsh on the ball of the foot, and sometimes prove to be uncomfortable and even painful. This last observation led the applicant to devise a new model of insole which, due to its new structural conformation, proves to be softer for the foot to rest on, without adversely affecting the efficiency of the massaging action which the insole is still able to carry out on the ball of the foot.

The desired result was obtained in the model according to the invention, by providing a series of hollow humps, projecting from the insole, which are made from the same plastic material and during the same moulding phase as the insole.

In short, when the insole according to the invention, is applied to the traditional sole in wood or other material, for clogs or mules, the ball of the foot comes to rest on a series of humps which are hollow inside, and within which air is hermetically sealed, due to the fact that they are enclosed by the part of the sole to which the insole has been glued. It is clear that these hollow humps which can be of any number or shape but preferably semispherical or semicylindrical, are far more yielding and much softer than the solid rounded humps currently employed on "auto-massaging" insoles, but, like the solid humps, the abovementioned hollow humps are also able, due to their elastic deformation under pressure, to carry out a massaging action on the ball of the foot, which may perhaps be more delicate and softer, but certainly no less efficacious in its beneficial effect on the limb.

For further clarity of explanation, the description of the invention continues with reference to the attached drawings, which are reproduced for illustrative and not restrictive purposes, in which :

FIG. 1, in a perspective drawing, illustrates a sole for clogs or mules on which the insole, according to the invention, has been applied.

Figure 2:
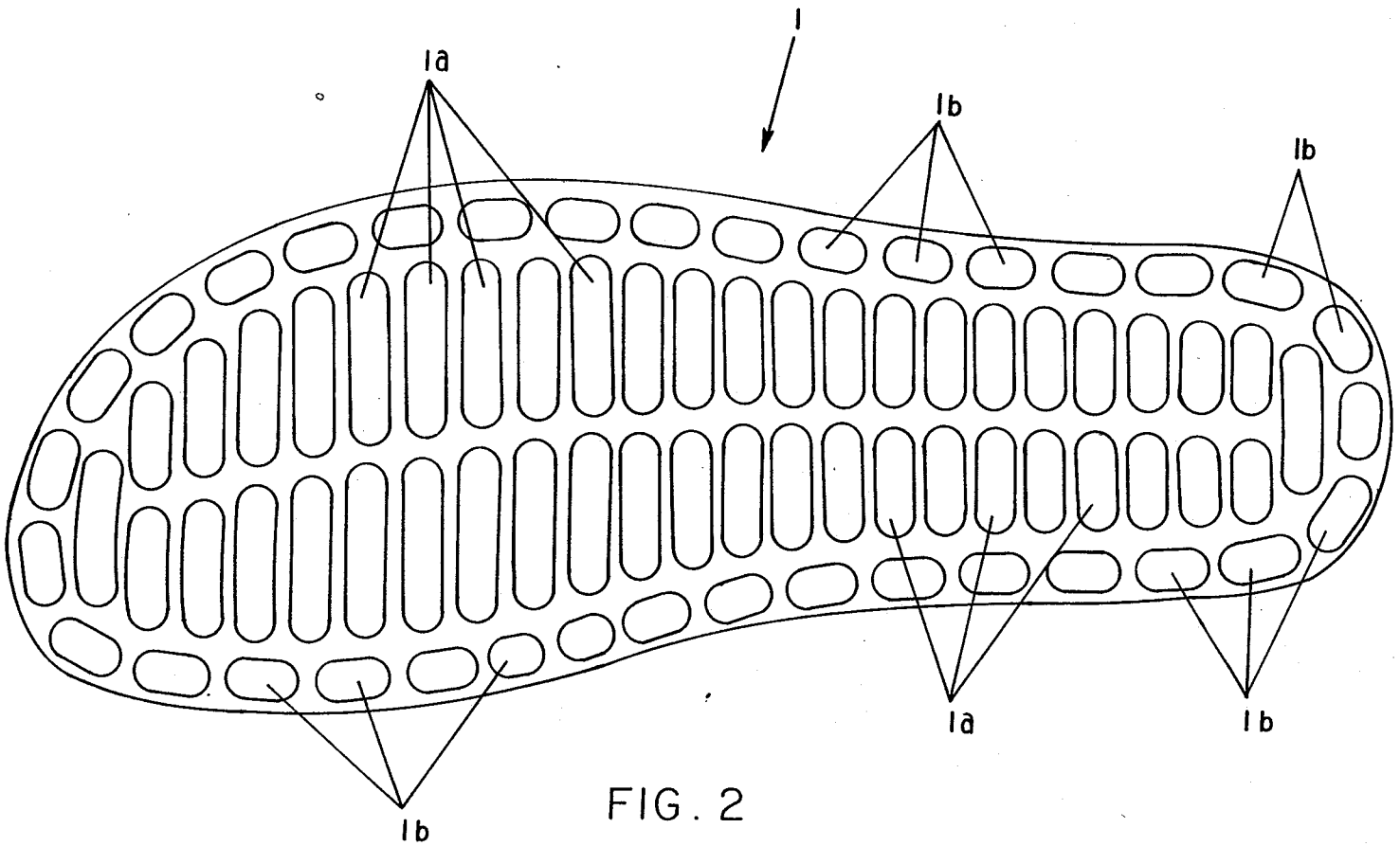

FIG. 2, in a plan view, illustrates the upper surface of the insole according to the invention.

Figure 3:
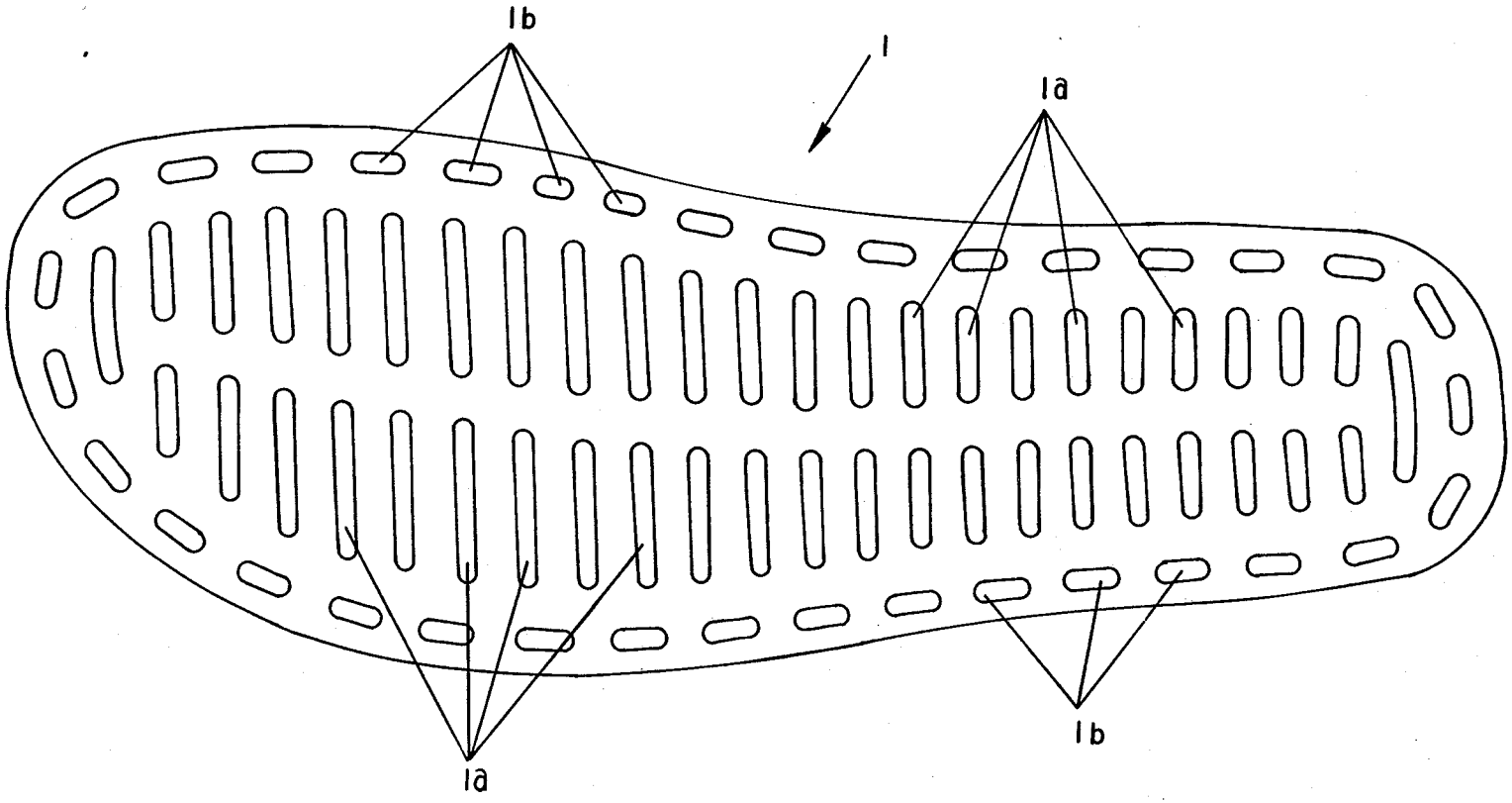

FIG. 3, in a plan view, illustrates the lower surface of the insole according to the invention.

Figure 4B:
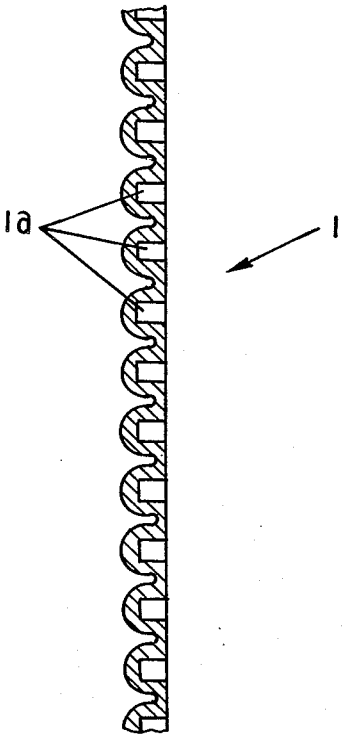
Figure 4A:
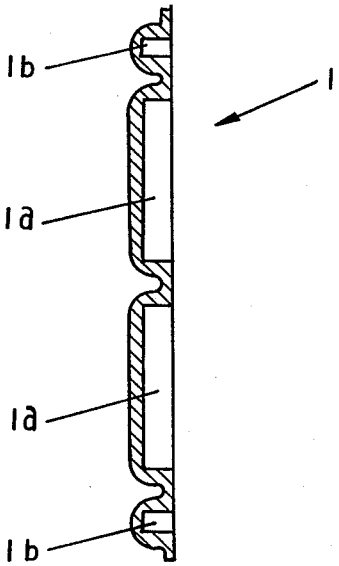

FIGS. 4*a* and 4*b* are two sections, one with longitudinal plane, the other with transversal plane of the insole according to the invention. With reference to the aforementioned figures, the model according to the invention, comprises an insole (1), moulded in PVC, with a flat bottom, on the top of which there is a closely packed series of hollow humps (1*a* and 1*b*), preferably semicylindrical in shape, inside which air is heretically sealed, when the insole (1) is glued to the sole (2).

The majority of the semicylindrical humps (1*a*) are arranged transversally and are surrounded by a series of semicylindrical humps (1*b*) which apart from massaging the foot as mentioned several times, also provide lateral support for the foot.

It goes without saying that the shape of these humps does not necessarily have to be semicylindrical but can be semispherical or semi-elipsoidal for example, without reducing the benefits pointed out above.

I claim:

1. In combination with the sole of a piece of footwear, a PVC insole with a bottom and a top surface having a plurality of hollow humps formed therein, comprised of: an insole, molded in PVC, on the top surface of which there is a closely packed series of hollow humps, each of the humps being open through the bottom and inside of which air is sealed when the bottom of the insole is directly secured to the sole, so that the sole encloses the humps for sealing the air therein.

2. The PVC insole of claim 1, wherein the hollow humps have a semicylindrical shape.

3. The PVC insole of claim 1, wherein the ;hollow humps have a semispherical shape.

4. The PVC insole of claim 1, wherein the hollow humps have a semi-elipsoidal shape.

5. The PVC insole of claim 1, wherein the insole includes a center and an outside edge and further wherein a portion of the hollow humps are positioned transversally and in the center of the insole, surrounded by a perimetral series of the remainder of the humps positioned around the outside edge of the insole.

* * * * *